US007903824B2

(12) United States Patent
Faller et al.

(10) Patent No.: US 7,903,824 B2
(45) Date of Patent: Mar. 8, 2011

(54) COMPACT SIDE INFORMATION FOR PARAMETRIC CODING OF SPATIAL AUDIO

(75) Inventors: Christof Faller, Tägerwilen (CH); Juergen Herre, Buckenhof (DE)

(73) Assignees: Agere Systems Inc., Allentown, PA (US); Fraunhofer-Gesellschaft zur Forderung der Angewandten Forschung E.V., Munich (DE)

( * ) Notice: Subject to any disclaimer, the term of this patent is extended or adjusted under 35 U.S.C. 154(b) by 1575 days.

(21) Appl. No.: 11/032,689

(22) Filed: Jan. 10, 2005

(65) Prior Publication Data

US 2006/0153408 A1 Jul. 13, 2006

(51) Int. Cl.
*H04R 5/00* (2006.01)

(52) U.S. Cl. ..... 381/23; 381/22; 704/501; 700/94

(58) Field of Classification Search ..... 381/22, 381/23, 17–21, 2, 119, 1; 700/500, 501, 700/94; 704/500, 501
See application file for complete search history.

(56) References Cited

U.S. PATENT DOCUMENTS

| | | | | |
|---|---|---|---|---|
| 4,236,039 | A * | 11/1980 | Cooper | 381/23 |
| 4,815,132 | A | 3/1989 | Minami | 381/1 |
| 4,972,484 | A | 11/1990 | Theile et al. | 704/200.1 |
| 5,371,799 | A | 12/1994 | Lowe et al. | 381/25 |
| 5,463,424 | A | 10/1995 | Dressler | 348/485 |
| 5,579,430 | A | 11/1996 | Grill et al. | 395/2.12 |
| 5,677,994 | A | 10/1997 | Miyamori et al. | 704/501 |
| 5,682,461 | A | 10/1997 | Silzle et al. | 395/2.14 |
| 5,701,346 | A | 12/1997 | Herre et al. | 381/18 |
| 5,771,295 | A | 6/1998 | Waller, Jr. | 381/18 |
| 5,812,971 | A | 9/1998 | Herre | 704/203 |
| 5,825,776 | A | 10/1998 | Moon | 370/437 |
| 5,860,060 | A | 1/1999 | Li et al. | 704/500 |
| 5,878,080 | A | 3/1999 | Ten Kate | 375/241 |

(Continued)

FOREIGN PATENT DOCUMENTS

CA 2 326 495 A1 6/2001

(Continued)

OTHER PUBLICATIONS

"Binaural Cue Coding: Rendering of Sources Mixed into a Mono Signal" by Christof Failer, Media Signal Processing Research, Agere Systems, Allentown, PA, USA, Mar. 2002, 2 pages.*

(Continued)

*Primary Examiner* — Vivian Chin
*Assistant Examiner* — Jason R Kurr
(74) *Attorney, Agent, or Firm* — Mendelsohn, Drucker & Associates, P.C.; Steve Mendelsohn

(57) ABSTRACT

At an audio encoder, cue codes are generated for one or more audio channels, wherein a combined cue code (e.g., a combined inter-channel correlation (ICC) code) is generated by combining two or more estimated cue codes, each estimated cue code estimated from a group of two or more channels. At an audio decoder, E transmitted audio channel(s) are decoded to generate C playback audio channels. Received cue codes include a combined cue code (e.g., a combined ICC code). One or more transmitted channel(s) are upmixed to generate one or more upmixed channels. One or more playback channels are synthesized by applying the cue codes to the one or more upmixed channels, wherein two or more derived cue codes are derived from the combined cue code, and each derived cue code is applied to generate two or more synthesized channels.

42 Claims, 8 Drawing Sheets

U.S. PATENT DOCUMENTS

| | | | | |
|---|---|---|---|---|
| 5,889,843 | A | 3/1999 | Singer et al. | 379/202.01 |
| 5,890,125 | A | 3/1999 | Davis et al. | 704/501 |
| 5,946,352 | A | 8/1999 | Rowlands et al. | 375/242 |
| 5,956,674 | A | 9/1999 | Smyth et al. | 704/200.1 |
| 6,016,473 | A * | 1/2000 | Dolby | 704/500 |
| 6,021,386 | A * | 2/2000 | Davis et al. | 704/229 |
| 6,021,389 | A | 2/2000 | Protopapas | 704/278 |
| 6,108,584 | A | 8/2000 | Edwards | 700/94 |
| 6,111,958 | A | 8/2000 | Maher | 381/17 |
| 6,131,084 | A | 10/2000 | Hardwick | 704/230 |
| 6,205,430 | B1 | 3/2001 | Hui | 704/500 |
| 6,282,631 | B1 | 8/2001 | Arbel | 712/35 |
| 6,356,870 | B1 | 3/2002 | Hui et al. | 704/500 |
| 6,408,327 | B1 | 6/2002 | McClennon et al. | 709/204 |
| 6,424,939 | B1 | 7/2002 | Herre et al. | 704/219 |
| 6,434,191 | B1 | 8/2002 | Agrawal et al. | 375/227 |
| 6,539,357 | B1 | 3/2003 | Sinha | 704/270.1 |
| 6,611,212 | B1 | 8/2003 | Craven et al. | |
| 6,614,936 | B1 | 9/2003 | Wu et al. | 382/238 |
| 6,658,117 | B2 | 12/2003 | Hasebe | 381/61 |
| 6,763,115 | B1 | 7/2004 | Kobayashi | 381/309 |
| 6,782,366 | B1 | 8/2004 | Huang et al. | 704/500 |
| 6,823,018 | B1 | 11/2004 | Jafarkhani et al. | 375/245 |
| 6,845,163 | B1 | 1/2005 | Johnston et al. | 381/92 |
| 6,850,496 | B1 | 2/2005 | Knappe et al. | 370/260 |
| 6,885,992 | B2 | 4/2005 | Mesarovic et al. | |
| 6,934,676 | B2 | 8/2005 | Wang et al. | 704/200.1 |
| 6,940,540 | B2 | 9/2005 | Beal et al. | 348/169 |
| 6,973,184 | B1 | 12/2005 | Shaffer et al. | 379/420.01 |
| 6,987,856 | B1 | 1/2006 | Feng et al. | |
| 7,116,787 | B2 | 10/2006 | Faller | 381/17 |
| 7,181,019 | B2 * | 2/2007 | Breebaart et al. | 381/23 |
| 7,382,886 | B2 | 6/2008 | Henn et al. | 381/23 |
| 7,516,066 | B2 | 4/2009 | Schuijers et al. | 704/219 |
| 2001/0031054 | A1 | 10/2001 | Grimani | 381/98 |
| 2001/0031055 | A1 | 10/2001 | Aarts et al. | |
| 2002/0055796 | A1 | 5/2002 | Katayama et al. | 700/94 |
| 2003/0035553 | A1 | 2/2003 | Baumgarte et al. | 381/94.2 |
| 2003/0044034 | A1 | 3/2003 | Zeng et al. | |
| 2003/0081115 | A1 | 5/2003 | Curry et al. | 348/14.12 |
| 2003/0161479 | A1 | 8/2003 | Yang et al. | 381/22 |
| 2003/0187663 | A1 | 10/2003 | Truman et al. | 704/500 |
| 2003/0219130 | A1 | 11/2003 | Baumgarte et al. | 381/17 |
| 2003/0236583 | A1 * | 12/2003 | Baumgarte et al. | 700/94 |
| 2004/0091118 | A1 | 5/2004 | Griesinger | 381/20 |
| 2005/0053242 | A1 * | 3/2005 | Henn et al. | 381/22 |
| 2005/0069143 | A1 | 3/2005 | Budnikov et al. | 381/63 |
| 2005/0157883 | A1 | 7/2005 | Herre et al. | 381/17 |
| 2005/0226426 | A1 | 10/2005 | Oomen et al. | 381/23 |
| 2006/0206323 | A1 * | 9/2006 | Breebaart | 704/230 |
| 2007/0094012 | A1 | 4/2007 | Pang et al. | |

FOREIGN PATENT DOCUMENTS

| | | | |
|---|---|---|---|
| CN | 1295778 | | 5/2001 |
| EP | 1 107 232 | A2 | 6/2001 |
| EP | 1 376 538 | A1 | 1/2004 |
| EP | 1 479 071 | B1 | 1/2006 |
| JP | 07123008 | | 5/1995 |
| JP | H10-051313 | | 2/1998 |
| JP | 2000-151413 | A | 5/2000 |
| JP | 2001-339311 | A | 12/2001 |
| JP | 2004-535145 | A | 11/2004 |
| RU | 2214048 | C2 | 10/2003 |
| TW | 347623 | | 12/1998 |
| TW | 360859 | | 6/1999 |
| TW | 444511 | | 7/2001 |
| TW | 510144 | | 11/2002 |
| TW | 517223 | | 1/2003 |
| TW | 521261 | | 2/2003 |
| WO | WO 03/007656 | A1 | 1/2003 |
| WO | WO 03/090208 | A1 | 10/2003 |
| WO | WO 03/094369 | A2 | 11/2003 |
| WO | WO 2004/008806 | A1 | 1/2004 |
| WO | WO 2004/049309 | A1 | 1/2004 |
| WO | WO 2004/072956 | A1 | 8/2004 |
| WO | WO 2004/077884 | A1 | 9/2004 |
| WO | WO 2004/086817 | A2 | 10/2004 |
| WO | WO 2005/069274 | A1 | 7/2005 |

OTHER PUBLICATIONS

"HILN-The MPEG-4 Parametric Audio Coding Tools" by Heiko Purnhagen and Nikolaus Meine, University of Hannover, Hannover, Germany, May 28-31, 2000, 4 pages.*

"Parametric Audio Coding" by Bernd Edler and Heiko Purnhagen, University of Hannover, Hannover, Germany, Aug. 21-25, 2000, pp. 1-4.*

"*Final text for DIS 11172-1 (rev. 2): Information Technology-Coding of Moving Pictures and Associated Audio for Digital Storage Media—Part 1*," ISO/IEC JTC 1/SC 29 N 147, Apr. 20, 1992, Section 3: Audio, XP-002083108, 2 pages.

"Binaural Cue Coding: Rendering of Sources Mixed into a Mono Signal" by Christof Faller, Media Signal Processing Research, Agere Systems, Allentown, PA, USA, 2 pages.

"HILN—The MPEG-4 Parametric Audio Coding Tools" by Heiko Purnhagen and Nikolaus Meine, University of Hannover, Hannover, Germany, 4 pages.

"Parametric Audio Coding" by Bernd Edler and Heiko Purnhagen, University of Hannover, Hannover, Germany, pp. 1-4.

"Advances in Parametric Audio Coding" by Heiko Purnhagen, Proc. 1999 IEEE Workshop on Applications of Signal Processing to Audio and Acoustics, New Paltz, New York, Oct. 17-20, 1999, pp. W99-1-W99-4.

"Surround Sound Past, Present, and Future" by Joseph Hull; Dolby Laboratories Inc.; 1999; 8 pages.

"Binaural Cue Coding—Part I: Psychoacoustic Fundamentals and Design Principles", by Frank Baumgrate et al., IEEE Transactions on Speech and Audio Processing, vol. II, No. 6, Nov. 2003, pp. 509-519.

"Binaural Cue Coding—Part II: Schemes and Applications", by Christof Faller et al., IEEE Transactions on Speech and Audio Processing, vol. II, No. 6, Nov. 2003, pp. 520-531.

"Low Complexity Parametric Stereo Coding", by Erik Schuijers et al., Audio Engineering Society 116$^{th}$ Convention Paper 6073, May 8-11, 2004, Berlin, Germany, pp. 1-11.

"MP3 Surround: Efficient and Compatible Coding of Multi-Channel Audio", by Juergen Herre et al., Audio Engineering Society 116$^{th}$ Convention Paper, May 8-11, 2004, Berlin, Germany, pp. 1-14.

"Coding of Spatial Audio Compatible With Different Playback Formats", by Christof Faller, Audio Engineering Society 117$^{th}$ Convention, San Francisco, CA, Oct. 28-31, 2004, pp. 1-12.

"Advances in Parametric Coding for High-Quality Audio," by Erik Schuijers et al., Audio Engineering Society Convention Paper 5852, 114$^{th}$ Convention, Amsterdam, The Netherlands, Mar. 22-25, 2003, pp. 1-11.

"Advances in Parametric Coding for High-Quality Audio," by E.G.P. Schuijers et al., Proc. 1$^{st}$ IEEE Benelux Workshop on Model Based Processing and Coding of Audio (MPCA-2002), Leuven, Belgium, Nov. 15, 2002, pp. 73-79, XP001156065.

"Improving Audio Codecs by Noise Substitution," by Donald Schulz, Journal of the Audio Engineering Society, vol. 44, No. 7/8, Jul./Aug. 1996, pp. 593-598, XP000733647.

"The Reference Model Architecture for MPEG Spatial Audio Coding," by Juergen Herre et al., Audio Engineering Society Convention Paper 6447, 118$^{th}$ Convention, May 28-31, 2005, Barcelona, Spain, pp. 1-13, XP009059973.

"From Joint Stereo to Spatial Audio Coding—Recent Progress and Standardization," by Jurgen Herre, Proc. Of the 7$^{th}$ Int. Conference on Digital Audio Effects (DAFx' 04), Oct. 5-8, 2004, Naples, Italy, XP002367849.

"Parametric Coding of Spatial Audio," by Christof Faller, Proc. of the 7$^{th}$ Int. Conference on Digital Audio Effects (DAFx' 04), Oct. 5-8, 2004, Naples, Itlay, XP002367850.

"Parametric Coding of Spatial Audio—Thesis No. 3062," by Christof Faller, These Presentee a La Faculte Informatique et Communications Institit De Systemes De Communication Section Des Systems De Communication Ecole Polytechnique Fédérale De Lausanne Pour L'Obtention Du Grade De Docteur Es Sciences, Jul. 2004, XP002343263, Laussane, Section 5.3, pp. 71-84.

"Spatial Audio Coding: Next-generation efficient and compatible coding of multi-channel audio," Juergen Herre et al., Audio Engineering Society Convention Paper 117th Convention, Oct. 28-31, 2004, San Francisco, CA, pp. 1-13, XP002343375.
"MPEG Audio Layer II: A Generic Coding Standard for Two and Multichannel Sound for DVB, DAB and Computer Multimedia," by G. Stoll, International Broadcasting Convention, Sep. 14-18, 1995, Germany, XP006528918, pp. 136-144.
"Multichannel Natural Music Recording Based on Psychoacoustic Principles", by Gunther Theile, Extended version of the paper presented at the AES 19th International Conference, May 2001, Oct. 2001, pp. 1-45.
Christof Faller, "Parametric Coding of Spatial Audio, These No. 3062," Presentee A La Faculte Informatique et Communications, Institut de Systemes de Communication, Ecole Polytechnique Federale de Lausanne, Lausanne, EPFL 2004.
Office Action for Japanese Patent Application No. 2007-537133 dated Feb. 16, 2010 received on Mar. 10, 2010.
van der Waal, R.G. et al., "Subband Coding of Stereographic Digital Audio Signals," Proc. of ICASSP '91, IEEE Computer Society, May 1991, pp. 3601-3604.
Notification of Reasons for Refusal received in JP 2007-549803 mailing date Nov. 25, 2010.

* cited by examiner

COMPACT SIDE INFORMATION FOR PARAMETRIC CODING OF SPATIAL AUDIO

CROSS-REFERENCE TO RELATED APPLICATIONS

The subject matter of this application is related to the subject matter of the following U.S. applications, the teachings of all of which are incorporated herein by reference:

- U.S. application Ser. No. 09/848,877, filed on May 4, 2001;
- U.S. application Ser. No. 10/045,458, filed on Nov. 7, 2001, which itself claimed the benefit of the filing date of U.S. provisional application No. 60/311,565, filed on Aug. 10, 2001;
- U.S. application Ser. No. 10/155,437, filed on May 24, 2002;
- U.S. application Ser. No. 10/246,570, filed on Sep. 18, 2002;
- U.S. application Ser. No. 10/815,591, filed on Apr. 1, 2004;
- U.S. application Ser. No. 10/936,464, filed on Sep. 8, 2004;
- U.S. application Ser. No. 10/762,100, filed on Jan. 20, 2004;
- U.S. application Ser. No. 11/006,492, filed on Dec. 7, 2004; and
- U.S. application Ser. No. 11/006,482, filed on Dec. 7, 2004.

The subject matter of this application is also related to subject matter described in the following papers, the teachings of all of which are incorporated herein by reference:

- F. Baumgarte and C. Faller, "Binaural Cue Coding—Part I: Psychoacoustic fundamentals and design principles," *IEEE Trans. on Speech and Audio Proc.*, vol. 11, no. 6, November 2003;
- C. Faller and F. Baumgarte, "Binaural Cue Coding—Part II: Schemes and applications," *IEEE Trans. on Speech and Audio Proc.*, vol. 11, no. 6, November 2003; and
- C. Faller, "Coding of spatial audio compatible with different playback formats," *Preprint* 117$^{th}$ *Conv. Aud. Eng. Soc.*, October 2004.

BACKGROUND OF THE INVENTION

1. Field of the Invention

The present invention relates to the encoding of audio signals and the subsequent synthesis of auditory scenes from the encoded audio data.

2. Description of the Related Art

When a person hears an audio signal (i.e., sounds) generated by a particular audio source, the audio signal will typically arrive at the person's left and right ears at two different times and with two different audio (e.g., decibel) levels, where those different times and levels are functions of the differences in the paths through which the audio signal travels to reach the left and right ears, respectively. The person's brain interprets these differences in time and level to give the person the perception that the received audio signal is being generated by an audio source located at a particular position (e.g., direction and distance) relative to the person. An auditory scene is the net effect of a person simultaneously hearing audio signals generated by one or more different audio sources located at one or more different positions relative to the person.

The existence of this processing by the brain can be used to synthesize auditory scenes, where audio signals from one or more different audio sources are purposefully modified to generate left and right audio signals that give the perception that the different audio sources are located at different positions relative to the listener.

FIG. 1 shows a high-level block diagram of conventional binaural signal synthesizer 100, which converts a single audio source signal (e.g., a mono signal) into the left and right audio signals of a binaural signal, where a binaural signal is defined to be the two signals received at the eardrums of a listener. In addition to the audio source signal, synthesizer 100 receives a set of spatial cues corresponding to the desired position of the audio source relative to the listener. In typical implementations, the set of spatial cues comprises an inter-channel level difference (ICLD) value (which identifies the difference in audio level between the left and right audio signals as received at the left and right ears, respectively) and an inter-channel time difference (ICTD) value (which identifies the difference in time of arrival between the left and right audio signals as received at the left and right ears, respectively). In addition or as an alternative, some synthesis techniques involve the modeling of a direction-dependent transfer function for sound from the signal source to the eardrums, also referred to as the head-related transfer function (HRTF). See, e.g., J. Blauert, *The Psychophysics of Human Sound Localization*, MIT Press, 1983, the teachings of which are incorporated herein by reference.

Using binaural signal synthesizer 100 of FIG. 1, the mono audio signal generated by a single sound source can be processed such that, when listened to over headphones, the sound source is spatially placed by applying an appropriate set of spatial cues (e.g., ICLD, ICTD, and/or HRTF) to generate the audio signal for each ear. See, e.g., D. R. Begault, 3-*D Sound for Virtual Reality and Multimedia*, Academic Press, Cambridge, Mass., 1994.

Binaural signal synthesizer 100 of FIG. 1 generates the simplest type of auditory scenes: those having a single audio source positioned relative to the listener. More complex auditory scenes comprising two or more audio sources located at different positions relative to the listener can be generated using an auditory scene synthesizer that is essentially implemented using multiple instances of binaural signal synthesizer, where each binaural signal synthesizer instance generates the binaural signal corresponding to a different audio source. Since each different audio source has a different location relative to the listener, a different set of spatial cues is used to generate the binaural audio signal for each different audio source.

SUMMARY OF THE INVENTION

According to one embodiment, the present invention is a method, apparatus, and machine-readable medium for encoding audio channels. One or more cue codes are generated for two or more audio channels, wherein at least one cue code is a combined cue code generated by combining two or more estimated cue codes, and each estimated cue code is estimated from a group of two or more of the audio channels.

According to another embodiment, the present invention is an apparatus for encoding C input audio channels to generate E transmitted audio channel(s). The apparatus comprises a code estimator and a downmixer. The code estimator generates one or more cue codes for two or more audio channels, wherein at least one cue code is a combined cue code generated by combining two or more estimated cue codes, and each estimated cue code is estimated from a group of two or more of the audio channels. The downmixer downmixes the C input channels to generate the E transmitted channel(s), where $C>E\geqq 1$, wherein the apparatus is adapted to transmit information about the cue codes to enable a decoder to perform synthesis processing during decoding of the E transmitted channel(s).

According to another embodiment, the present invention is an encoded audio bitstream generated by encoding audio channels, wherein one or more cue codes are generated for two or more audio channels, wherein at least one cue code is a combined cue code generated by combining two or more estimated cue codes, and each estimated cue code is estimated from a group of two or more of the audio channels. The one or more cue codes and E transmitted audio channel(s) corresponding to the two or more audio channels, where E≧1, are encoded into the encoded audio bitstream.

According to another embodiment, the present invention is an encoded audio bitstream comprising one or more cue codes and E transmitted audio channel(s). The one or more cue codes are generated for two or more audio channels, wherein at least one cue code is a combined cue code generated by combining two or more estimated cue codes, and each estimated cue code is estimated from a group of two or more of the audio channels. The E transmitted audio channel(s) correspond to the two or more audio channels.

According to another embodiment, the present invention is a method, apparatus, and machine-readable medium for decoding E transmitted audio channel(s) to generate C playback audio channels, where C>E≧1. Cue codes corresponding to the E transmitted channel(s) are received, wherein at least one cue code is a combined cue code generated by combining two or more estimated cue codes, and each estimated cue code estimated from a group of two or more audio channels corresponding to the E transmitted channel(s). One or more of the E transmitted channel(s) are upmixed to generate one or more upmixed channels. One or more of the C playback channels are synthesized by applying the cue codes to the one or more upmixed channels, wherein two or more derived cue codes are derived from the combined cue code, and each derived cue code is applied to generate two or more synthesized channels.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Figure 1:
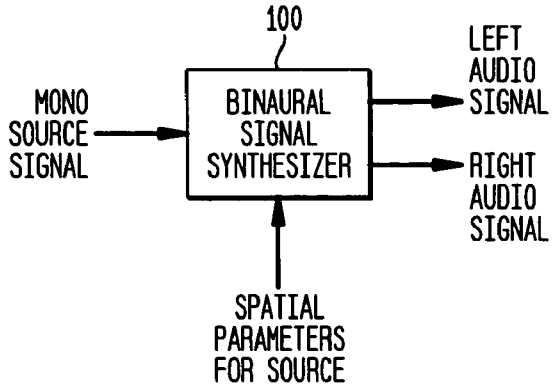
FIG. 1 (PRIOR ART)
FIG. 1 shows a high-level block diagram of conventional binaural signal synthesizer.

In binaural cue coding (BCC), an encoder encodes C input audio channels to generate E transmitted audio channels, where C>E≧1. In particular, two or more of the C input channels are provided in a frequency domain, and one or more cue codes are generated for each of one or more different frequency bands in the two or more input channels in the frequency domain. In addition, the C input channels are downmixed to generate the E transmitted channels. In some downmixing implementations, at least one of the E transmitted channels is based on two or more of the C input channels, and at least one of the E transmitted channels is based on only a single one of the C input channels.

In one embodiment, a BCC coder has two or more filter banks, a code estimator, and a downmixer. The two or more filter banks convert two or more of the C input channels from a time domain into a frequency domain. The code estimator generates one or more cue codes for each of one or more different frequency bands in the two or more converted input channels. The downmixer downmixes the C input channels to generate the E transmitted channels, where C>E≧1.

In BCC decoding, E transmitted audio channels are decoded to generate C playback audio channels. In particular, for each of one or more different frequency bands, one or more of the E transmitted channels are upmixed in a frequency domain to generate two or more of the C playback channels in the frequency domain, where C>E≧1. One or more cue codes are applied to each of the one or more different frequency bands in the two or more playback channels in the frequency domain to generate two or more modified channels, and the two or more modified channels are converted from the frequency domain into a time domain. In some upmixing implementations, at least one of the C playback channels is based on at least one of the E transmitted channels and at least one cue code, and at least one of the C playback channels is based on only a single one of the E transmitted channels and independent of any cue codes.

In one embodiment, a BCC decoder has an upmixer, a synthesizer, and one or more inverse filter banks. For each of one or more different frequency bands, the upmixer upmixes one or more of the E transmitted channels in a frequency domain to generate two or more of the C playback channels in the frequency domain, where C>E≧1. The synthesizer applies one or more cue codes to each of the one or more different frequency bands in the two or more playback channels in the frequency domain to generate two or more modified channels. The one or more inverse filter banks convert the two or more modified channels from the frequency domain into a time domain.

Depending on the particular implementation, a given playback channel may be based on a single transmitted channel, rather than a combination of two or more transmitted channels. For example, when there is only one transmitted channel, each of the C playback channels is based on that one transmitted channel. In these situations, upmixing corresponds to copying of the corresponding transmitted channel. As such, for applications in which there is only one transmitted channel, the upmixer may be implemented using a replicator that copies the transmitted channel for each playback channel.

BCC encoders and/or decoders may be incorporated into a number of systems or applications including, for example, digital video recorders/players, digital audio recorders/players, computers, satellite transmitters/receivers, cable transmitters/receivers, terrestrial broadcast transmitters/receivers, home entertainment systems, and movie theater systems.

Generic BCC Processing

Figure 2:
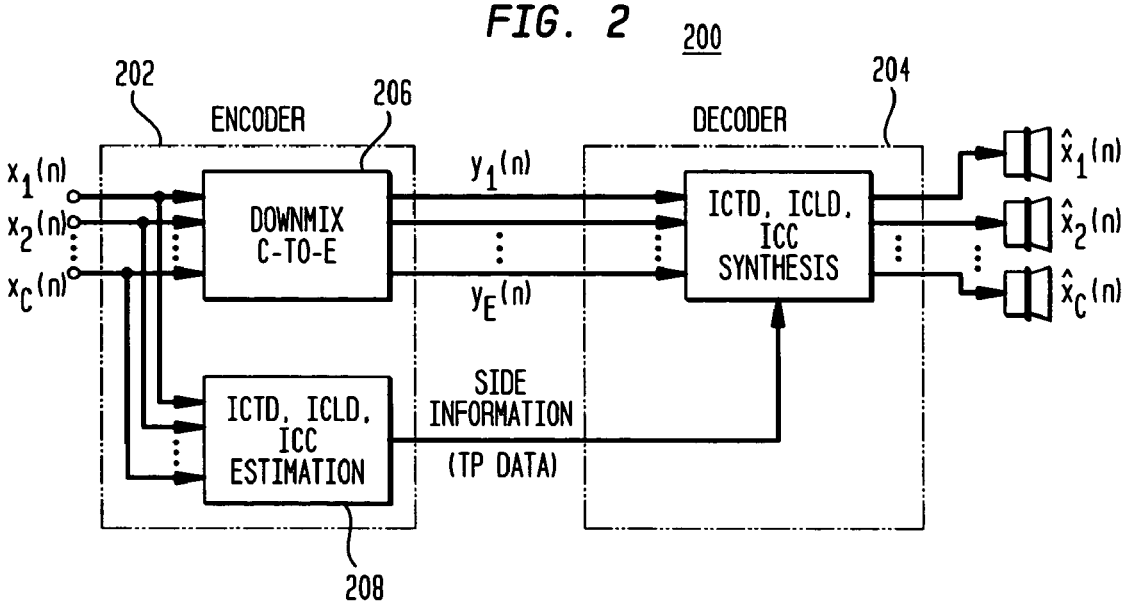
FIG. 2 is a block diagram of a generic binaural cue coding (BCC) audio processing system.

FIG. 2 is a block diagram of a generic binaural cue coding (BCC) audio processing system 200 comprising an encoder 202 and a decoder 204. Encoder 202 includes downmixer 206 and BCC estimator 208.

Downmixer 206 converts C input audio channels $x_i(n)$ into E transmitted audio channels $y_i(n)$, where $C>E\geqq 1$. In this specification, signals expressed using the variable n are time-domain signals, while signals expressed using the variable k are frequency-domain signals. Depending on the particular implementation, downmixing can be implemented in either the time domain or the frequency domain. BCC estimator 208 generates BCC codes from the C input audio channels and transmits those BCC codes as either in-band or out-of-band side information relative to the E transmitted audio channels. Typical BCC codes include one or more of inter-channel time difference (ICTD), inter-channel level difference (ICLD), and inter-channel correlation (ICC) data estimated between certain pairs of input channels as a function of frequency and time. The particular implementation will dictate between which particular pairs of input channels, BCC codes are estimated.

ICC data corresponds to the coherence of a binaural signal, which is related to the perceived width of the audio source. The wider the audio source, the lower the coherence between the left and right channels of the resulting binaural signal. For example, the coherence of the binaural signal corresponding to an orchestra spread out over an auditorium stage is typically lower than the coherence of the binaural signal corresponding to a single violin playing solo. In general, an audio signal with lower coherence is usually perceived as more spread out in auditory space. As such, ICC data is typically related to the apparent source width and degree of listener envelopment. See, e.g., J. Blauert, *The Psychophysics of Human Sound Localization*, MIT Press, 1983.

Depending on the particular application, the E transmitted audio channels and corresponding BCC codes may be transmitted directly to decoder 204 or stored in some suitable type of storage device for subsequent access by decoder 204. Depending on the situation, the term "transmitting" may refer to either direct transmission to a decoder or storage for subsequent provision to a decoder. In either case, decoder 204 receives the transmitted audio channels and side information and performs upmixing and BCC synthesis using the BCC codes to convert the E transmitted audio channels into more than E (typically, but not necessarily, C) playback audio channels $\hat{x}_i(n)$ for audio playback. Depending on the particular implementation, upmixing can be performed in either the time domain or the frequency domain.

In addition to the BCC processing shown in FIG. 2, a generic BCC audio processing system may include additional encoding and decoding stages to further compress the audio signals at the encoder and then decompress the audio signals at the decoder, respectively. These audio codecs may be based on conventional audio compression/decompression techniques such as those based on pulse code modulation (PCM), differential PCM (DPCM), or adaptive DPCM (ADPCM).

When downmixer 206 generates a single sum signal (i.e., E=1), BCC coding is able to represent multi-channel audio signals at a bitrate only slightly higher than what is required to represent a mono audio signal. This is so, because the estimated ICTD, ICLD, and ICC data between a channel pair contain about two orders of magnitude less information than an audio waveform.

Not only the low bitrate of BCC coding, but also its backwards compatibility aspect is of interest. A single transmitted sum signal corresponds to a mono downmix of the original stereo or multi-channel signal. For receivers that do not support stereo or multi-channel sound reproduction, listening to the transmitted sum signal is a valid method of presenting the audio material on low-profile mono reproduction equipment. BCC coding can therefore also be used to enhance existing services involving the delivery of mono audio material towards multi-channel audio. For example, existing mono audio radio broadcasting systems can be enhanced for stereo or multi-channel playback if the BCC side information can be embedded into the existing transmission channel. Analogous capabilities exist when downmixing multi-channel audio to two sum signals that correspond to stereo audio.

BCC processes audio signals with a certain time and frequency resolution. The frequency resolution used is largely motivated by the frequency resolution of the human auditory system. Psychoacoustics suggests that spatial perception is most likely based on a critical band representation of the acoustic input signal. This frequency resolution is considered by using an invertible filterbank (e.g., based on a fast Fourier transform (FFT) or a quadrature mirror filter (QMF)) with subbands with bandwidths equal or proportional to the critical bandwidth of the human auditory system.

Generic Downmixing

In preferred implementations, the transmitted sum signal(s) contain all signal components of the input audio signal. The goal is that each signal component is fully maintained. Simply summation of the audio input channels often results in amplification or attenuation of signal components. In other words, the power of the signal components in a "simple" sum is often larger or smaller than the sum of the power of the corresponding signal component of each channel. A downmixing technique can be used that equalizes the sum signal such that the power of signal components in the sum signal is approximately the same as the corresponding power in all input channels.

Figure 3:
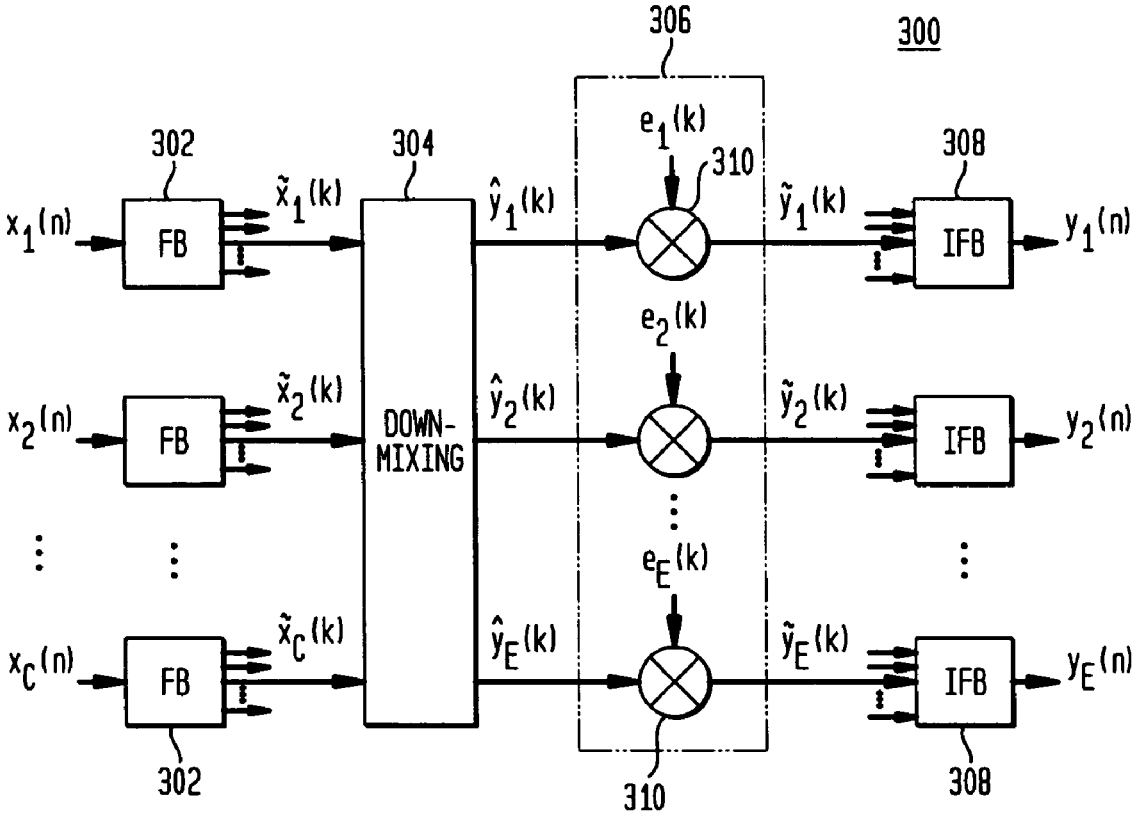
FIG. 3 shows a block diagram of a downmixer that can be used for the downmixer of FIG. 2.

FIG. 3 shows a block diagram of a downmixer 300 that can be used for downmixer 206 of FIG. 2 according to certain implementations of BCC system 200. Downmixer 300 has a filter bank (FB) 302 for each input channel $x_i(n)$, a downmixing block 304, an optional scaling/delay block 306, and an inverse FB (IFB) 308 for each encoded channel $y_i(n)$.

Each filter bank 302 converts each frame (e.g., 20 msec) of a corresponding digital input channel $x_i(n)$ in the time domain into a set of input coefficients $\tilde{x}_i(k)$ in the frequency domain. Downmixing block 304 downmixes each sub-band of C corresponding input coefficients into a corresponding sub-band of E downmixed frequency-domain coefficients. Equation (1) represents the downmixing of the kth sub-band of input coefficients $(\tilde{x}_1(k), \tilde{x}_2(k), \ldots, \tilde{x}_C(k))$ to generate the kth sub-band of downmixed coefficients $(\hat{y}_1(k), \hat{y}_2(k), \ldots, \hat{y}_E(k))$ as follows:

$$\begin{bmatrix} \hat{y}_1(k) \\ \hat{y}_2(k) \\ \vdots \\ \hat{y}_E(k) \end{bmatrix} = D_{CE} \begin{bmatrix} \hat{x}_1(k) \\ \hat{x}_2(k) \\ \vdots \\ \hat{x}_C(k) \end{bmatrix}, \tag{1}$$

where $D_{CE}$ is a real-valued C-by-E downmixing matrix.

Optional scaling/delay block 306 comprises a set of multipliers 310, each of which multiplies a corresponding downmixed coefficient $\hat{y}_i(k)$ by a scaling factor $e_i(k)$ to generate a corresponding scaled coefficient $\tilde{y}_i(k)$. The motivation for the scaling operation is equivalent to equalization generalized for downmixing with arbitrary weighting factors for each channel. If the input channels are independent, then the power $p_{\hat{y}_i(k)}$ of the downmixed signal in each sub-band is given by Equation (2) as follows:

$$\begin{bmatrix} p_{\hat{y}_1(k)} \\ p_{\hat{y}_2(k)} \\ \vdots \\ p_{\hat{y}_E(k)} \end{bmatrix} = \overline{D}_{CE} \begin{bmatrix} p_{\tilde{x}_1(k)} \\ p_{\tilde{x}_2(k)} \\ \vdots \\ p_{\tilde{x}_C(k)} \end{bmatrix}, \tag{2}$$

where $\overline{D}_{CE}$ is derived by squaring each matrix element in the C-by-E downmixing matrix $D_{CE}$ and $p_{\tilde{x}_i(k)}$ is the power of sub-band k of input channel i.

If the sub-bands are not independent, then the power values $p_{\hat{y}_i(k)}$ of the downmixed signal will be larger or smaller than that computed using Equation (2), due to signal amplifications or cancellations when signal components are in-phase or out-of-phase, respectively. To prevent this, the downmixing operation of Equation (1) is applied in sub-bands followed by the scaling operation of multipliers 310. The scaling factors $e_i(k)$ ($1 \leqq i \leqq E$) can be derived using Equation (3) as follows:

$$e_i(k) = \sqrt{\frac{p_{\tilde{y}_i(k)}}{p_{\hat{y}_i(k)}}}, \tag{3}$$

where $p_{\tilde{y}_i(k)}$ is the sub-band power as computed by Equation (2), and $p_{\hat{y}_i(k)}$ is power of the corresponding downmixed sub-band signal $\hat{y}_i(k)$.

In addition to or instead of providing optional scaling, scaling/delay block 306 may optionally apply delays to the signals.

Each inverse filter bank 308 converts a set of corresponding scaled coefficients $\tilde{y}_i(k)$ in the frequency domain into a frame of a corresponding digital, transmitted channel $y_i(n)$.

Although FIG. 3 shows all C of the input channels being converted into the frequency domain for subsequent downmixing, in alternative implementations, one or more (but less than C−1) of the C input channels might bypass some or all of the processing shown in FIG. 3 and be transmitted as an equivalent number of unmodified audio channels. Depending on the particular implementation, these unmodified audio channels might or might not be used by BCC estimator 208 of FIG. 2 in generating the transmitted BCC codes.

In an implementation of downmixer 300 that generates a single sum signal y(n), E=1 and the signals $\tilde{x}_c(k)$ of each subband of each input channel c are added and then multiplied with a factor e(k), according to Equation (4) as follows:

$$\tilde{y}(k) = e(k) \sum_{c=1}^{C} \tilde{x}_c(k). \tag{4}$$

the factor e(k) is given by Equation (5) as follows:

$$e(k) = \sqrt{\frac{\sum_{c=1}^{C} p_{\tilde{x}_c}(k)}{p_{\tilde{x}}(k)}}, \tag{5}$$

where $p_{\tilde{x}_c}(k)$ is a short-time estimate of the power of $\tilde{x}_c(k)$ at time index k, and $p_{\tilde{x}}(k)$ is a short-time estimate of the power of $$\sum_{c=1}^{C} \tilde{x}_c(k).$$

The equalized subbands are transformed back to the time domain resulting in the sum signal y(n) that is transmitted to the BCC decoder.

Generic BCC Synthesis

Figure 4:
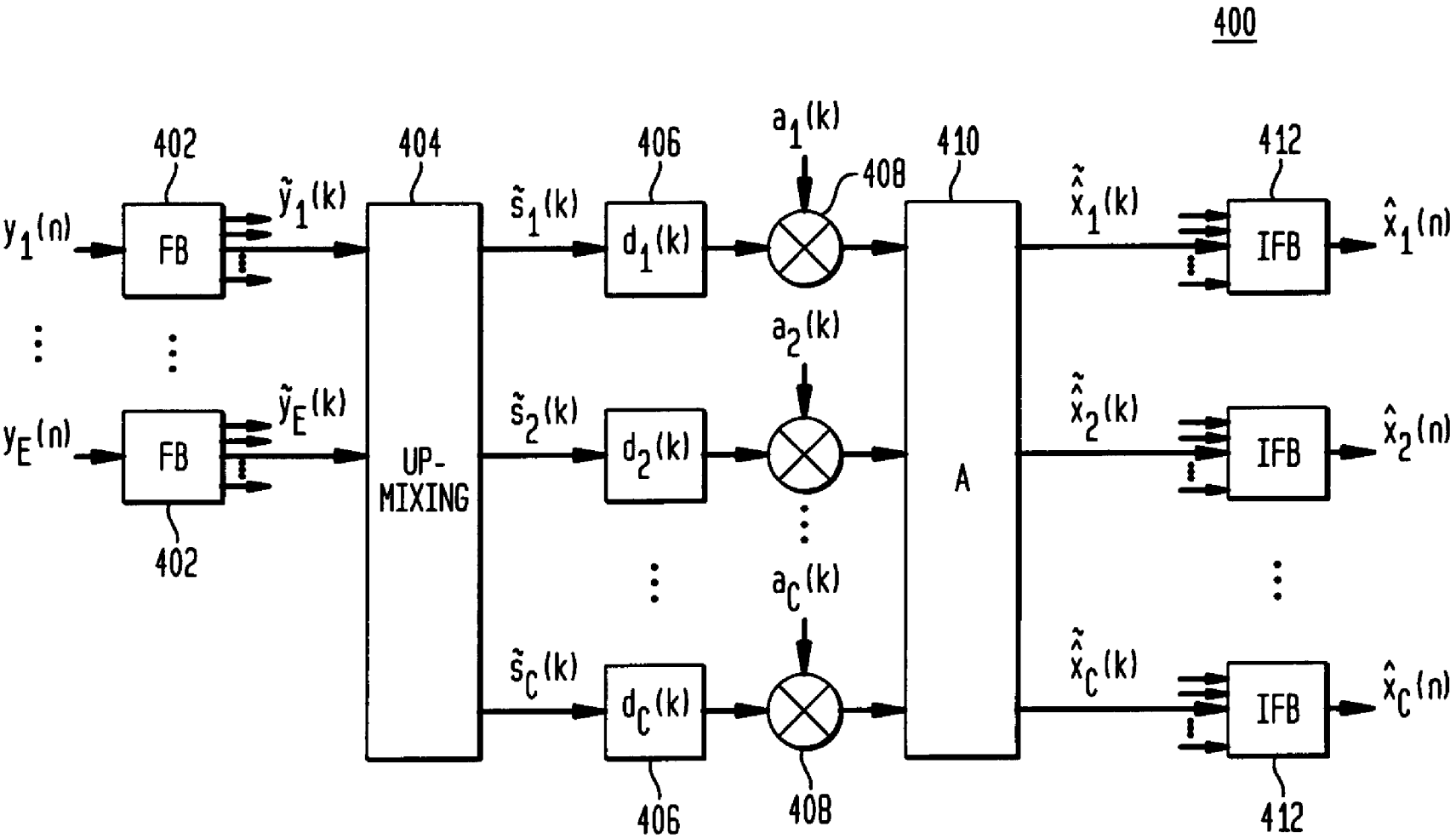
FIG. 4 shows a block diagram of a BCC synthesizer that can be used for the decoder of FIG. 2.

FIG. 4 shows a block diagram of a BCC synthesizer 400 that can be used for decoder 204 of FIG. 2 according to certain implementations of BCC system 200. BCC synthesizer 400 has a filter bank 402 for each transmitted channel $y_i(n)$, an upmixing block 404, delays 406, multipliers 408, correlation block 410, and an inverse filter bank 412 for each playback channel $\hat{x}_i(n)$.

Each filter bank 402 converts each frame of a corresponding digital, transmitted channel $y_i(n)$ in the time domain into a set of input coefficients $\tilde{y}_i(k)$ in the frequency domain. Upmixing block 404 upmixes each sub-band of E corresponding transmitted-channel coefficients into a corresponding sub-band of C upmixed frequency-domain coefficients. Equation (4) represents the upmixing of the kth sub-band of transmitted-channel coefficients ($\tilde{y}_1(k), \tilde{y}_2(k), \ldots, \tilde{y}_E(k)$) to generate the kth sub-band of upmixed coefficients ($\tilde{s}_1(k), \tilde{s}_2(k), \ldots, \tilde{s}_C(k)$) as follows:

$$\begin{bmatrix} \tilde{s}_1(k) \\ \tilde{s}_2(k) \\ \vdots \\ \tilde{s}_C(k) \end{bmatrix} = U_{EC} \begin{bmatrix} \tilde{y}_1(k) \\ \tilde{y}_2(k) \\ \vdots \\ \tilde{y}_E(k) \end{bmatrix}, \tag{6}$$

where $U_{EC}$ is a real-valued E-by-C upmixing matrix. Performing upmixing in the frequency-domain enables upmixing to be applied individually in each different sub-band.

Each delay 406 applies a delay value $d_i(k)$ based on a corresponding BCC code for ICTD data to ensure that the desired ICTD values appear between certain pairs of playback channels. Each multiplier 408 applies a scaling factor $a_i(k)$ based on a corresponding BCC code for ICLD data to ensure that the desired ICLD values appear between certain pairs of playback channels. Correlation block 410 performs a decorrelation operation A based on corresponding BCC codes for ICC data to ensure that the desired ICC values appear between certain pairs of playback channels. Further description of the operations of correlation block 410 can be found in U.S. patent application Ser. No. 10/155,437, filed on May 24, 2002.

The synthesis of ICLD values may be less troublesome than the synthesis of ICTD and ICC values, since ICLD synthesis involves merely scaling of sub-band signals. Since ICLD cues are the most commonly used directional cues, it is usually more important that the ICLD values approximate those of the original audio signal. As such, ICLD data might be estimated between all channel pairs. The scaling factors $a_i(k)$ ($1 \leqq i \leqq C$) for each sub-band are preferably chosen such that the sub-band power of each playback channel approximates the corresponding power of the original input audio channel.

One goal may be to apply relatively few signal modifications for synthesizing ICTD and ICC values. As such, the BCC data might not include ICTD and ICC values for all channel pairs. In that case, BCC synthesizer 400 would synthesize ICTD and ICC values only between certain channel pairs.

Each inverse filter bank 412 converts a set of corresponding synthesized coefficients $\tilde{\hat{x}}_i(k)$ in the frequency domain into a frame of a corresponding digital, playback channel $\hat{x}_i(n)$.

Although FIG. 4 shows all E of the transmitted channels being converted into the frequency domain for subsequent upmixing and BCC processing, in alternative implementations, one or more (but not all) of the E transmitted channels might bypass some or all of the processing shown in FIG. 4. For example, one or more of the transmitted channels may be unmodified channels that are not subjected to any upmixing. In addition to being one or more of the C playback channels, these unmodified channels, in turn, might be, but do not have to be, used as reference channels to which BCC processing is applied to synthesize one or more of the other playback channels. In either case, such unmodified channels may be subjected to delays to compensate for the processing time involved in the upmixing and/or BCC processing used to generate the rest of the playback channels.

Note that, although FIG. 4 shows C playback channels being synthesized from E transmitted channels, where C was also the number of original input channels, BCC synthesis is not limited to that number of playback channels. In general, the number of playback channels can be any number of channels, including numbers greater than or less than C and possibly even situations where the number of playback channels is equal to or less than the number of transmitted channels.

"Perceptually Relevant Differences" Between Audio Channels

Assuming a single sum signal, BCC synthesizes a stereo or multi-channel audio signal such that ICTD, ICLD, and ICC approximate the corresponding cues of the original audio signal. In the following, the role of ICTD, ICLD, and ICC in relation to auditory spatial image attributes is discussed.

Knowledge about spatial hearing implies that for one auditory event, ICTD and ICLD are related to perceived direction. When considering binaural room impulse responses (BRIRs) of one source, there is a relationship between width of the auditory event and listener envelopment and ICC data estimated for the early and late parts of the BRIRs. However, the relationship between ICC and these properties for general signals (and not just the BRIRs) is not straightforward.

Stereo and multi-channel audio signals usually contain a complex mix of concurrently active source signals superimposed by reflected signal components resulting from recording in enclosed spaces or added by the recording engineer for artificially creating a spatial impression. Different source signals and their reflections occupy different regions in the time-frequency plane. This is reflected by ICTD, ICLD, and ICC, which vary as a function of time and frequency. In this case, the relation between instantaneous ICTD, ICLD, and ICC and auditory event directions and spatial impression is not obvious. The strategy of certain embodiments of BCC is to blindly synthesize these cues such that they approximate the corresponding cues of the original audio signal.

Filterbanks with subbands of bandwidths equal to two times the equivalent rectangular bandwidth (ERB) are used. Informal listening reveals that the audio quality of BCC does not notably improve when choosing higher frequency resolution. A lower frequency resolution may be desired, since it results in less ICTD, ICLD, and ICC values that need to be transmitted to the decoder and thus in a lower bitrate.

Regarding time resolution, ICTD, ICLD, and ICC are typically considered at regular time intervals. High performance is obtained when ICTD, ICLD, and ICC are considered about every 4 to 16 ms. Note that, unless the cues are considered at very short time intervals, the precedence effect is not directly considered. Assuming a classical lead-lag pair of sound stimuli, if the lead and lag fall into a time interval where only one set of cues is synthesized, then localization dominance of the lead is not considered. Despite this, BCC achieves audio quality reflected in an average MUSHRA score of about 87 (i.e., "excellent" audio quality) on average and up to nearly 100 for certain audio signals.

The often-achieved perceptually small difference between reference signal and synthesized signal implies that cues related to a wide range of auditory spatial image attributes are implicitly considered by synthesizing ICTD, ICLD, and ICC at regular time intervals. In the following, some arguments are given on how ICTD, ICLD, and ICC may relate to a range of auditory spatial image attributes.

Estimation of Spatial Cues

In the following, it is described how ICTD, ICLD, and ICC are estimated. The bitrate for transmission of these (quantized and coded) spatial cues can be just a few kb/s and thus, with BCC, it is possible to transmit stereo and multi-channel audio signals at bitrates close to what is required for a single audio channel.

Figure 5:
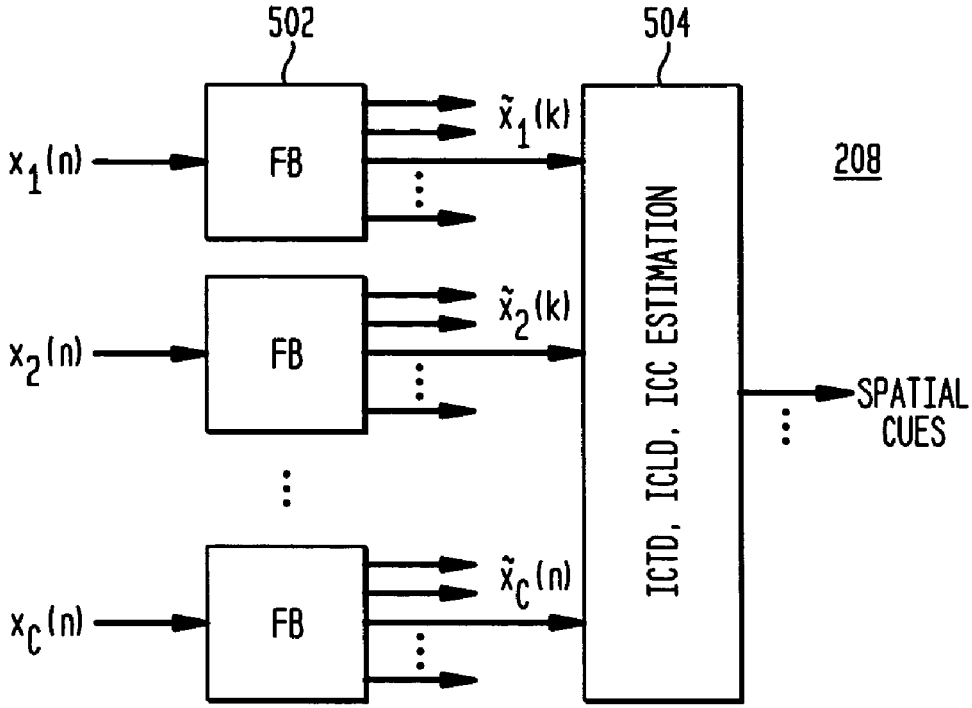
FIG. 5 shows a block diagram of the BCC estimator of FIG. 2, according to one embodiment of the present invention.

FIG. 5 shows a block diagram of BCC estimator 208 of FIG. 2, according to one embodiment of the present invention. BCC estimator 208 comprises filterbanks (FB) 502, which may be the same as filterbanks 302 of FIG. 3, and estimation block 504, which generates ICTD, ICLD, and ICC spatial cues for each different frequency subband generated by filterbanks 502.

Estimation of ICTD, ICLD, and ICC for Stereo Signals

The following measures are used for ICTD, ICLD, and ICC for corresponding subband signals $\tilde{x}_1(k)$ and $\tilde{2}_2(k)$ of two (e.g., stereo) audio channels:

ICTD [samples]:

$$\tau_{12}(k) = \underset{d}{\operatorname{argmax}}\{\Phi_{12}(d, k)\}, \tag{7}$$

with a short-time estimate of the normalized cross-correlation function given by Equation (8) as follows:

$$\Phi_{12}(d, k) = \frac{p_{\tilde{x}_1\tilde{x}_2}(d, k)}{\sqrt{p_{\tilde{x}_1}(k-d_1)p_{\tilde{x}_2}(k-d_2)}}, \tag{8}$$

where $$d_1 = \max\{-d, 0\} \tag{9}$$

$$d_2 = \max\{d, 0\} \tag{9}$$

and $p_{\tilde{x}_1}\tilde{x}_2(d,k)$ is a short-time estimate of the mean of $\tilde{x}_1(k-d_1)\tilde{x}_2(k-d_2)$ ICLD [dB]:

$$\Delta L_{12}(k) = 10\log_{10}\left(\frac{p_{\tilde{s}_2}(k)}{p_{\tilde{s}_1}(k)}\right). \tag{10}$$

ICC:

$$c_{12}(k) = \max_d |\Phi_{12}(d, k)|. \tag{11}$$

Note that the absolute value of the normalized cross-correlation is considered and $c_{12}(k)$ has a range of [0,1].

Estimation of ICTD, ICLD, and ICC for Multi-Channel Audio Signals

Figure 6:
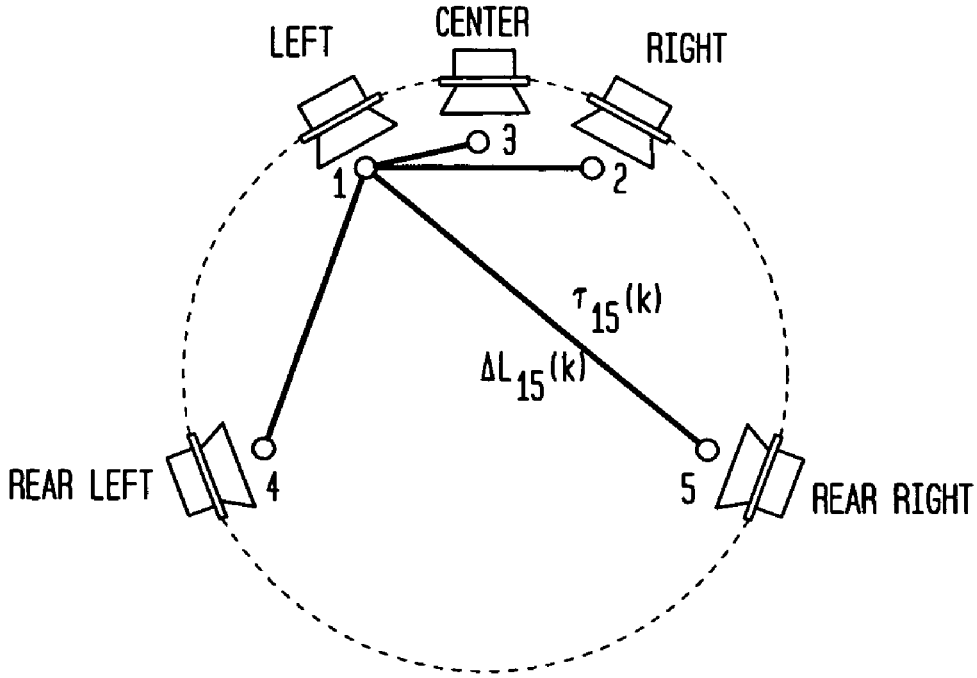
FIG. 6 illustrates the generation of ICTD and ICLD data for five-channel audio.

When there are more than two input channels, it is typically sufficient to define ICTD and ICLD between a reference channel (e.g., channel number 1) and the other channels, as illustrated in FIG. 6 for the case of C=5 channels. where $\tau_{1c}(k)$ and $\Delta L_{1c}(k)$ denote the ICTD and ICLD, respectively, between the reference channel 1 and channel c.

Figure 7A:
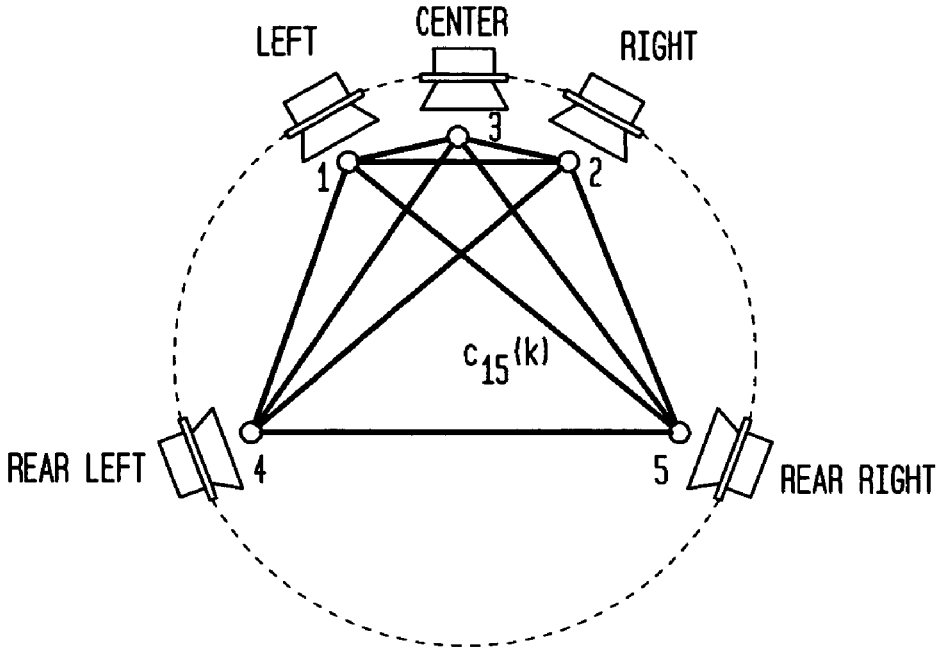
FIG. 7 illustrates the generation of ICC data for five-channel audio.
Figure 7B:
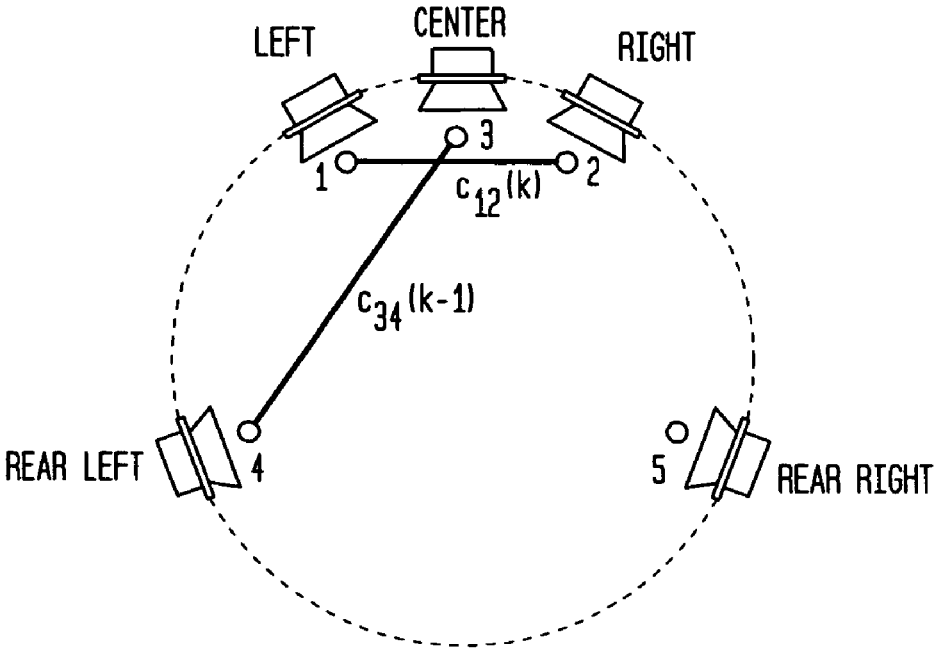

As opposed to ICTD and ICLD, ICC typically has more degrees of freedom. The ICC as defined can have different values between all possible input channel pairs. For C channels, there are C(C−1)/2 possible channel pairs; e.g., for 5 channels there are 10 channel pairs as illustrated in FIG. 7(*a*). However, such a scheme requires that, for each subband at each time index, C(C−1)/2 ICC values are estimated and transmitted, resulting in high computational complexity and high bitrate.

Alternatively, for each subband, ICTD and ICLD determine the direction at which the auditory event of the corresponding signal component in the subband is rendered. One single ICC parameter per subband may then be used to describe the overall coherence between all audio channels. Good results can be obtained by estimating and transmitting ICC cues only between the two channels with most energy in each subband at each time index. This is illustrated in FIG. 7(*b*), where for time instants k−1 and k the channel pairs (3, 4) and (1, 2) are strongest, respectively. A heuristic rule may be used for determining ICC between the other channel pairs.

Synthesis of Spatial Cues

Figure 8:
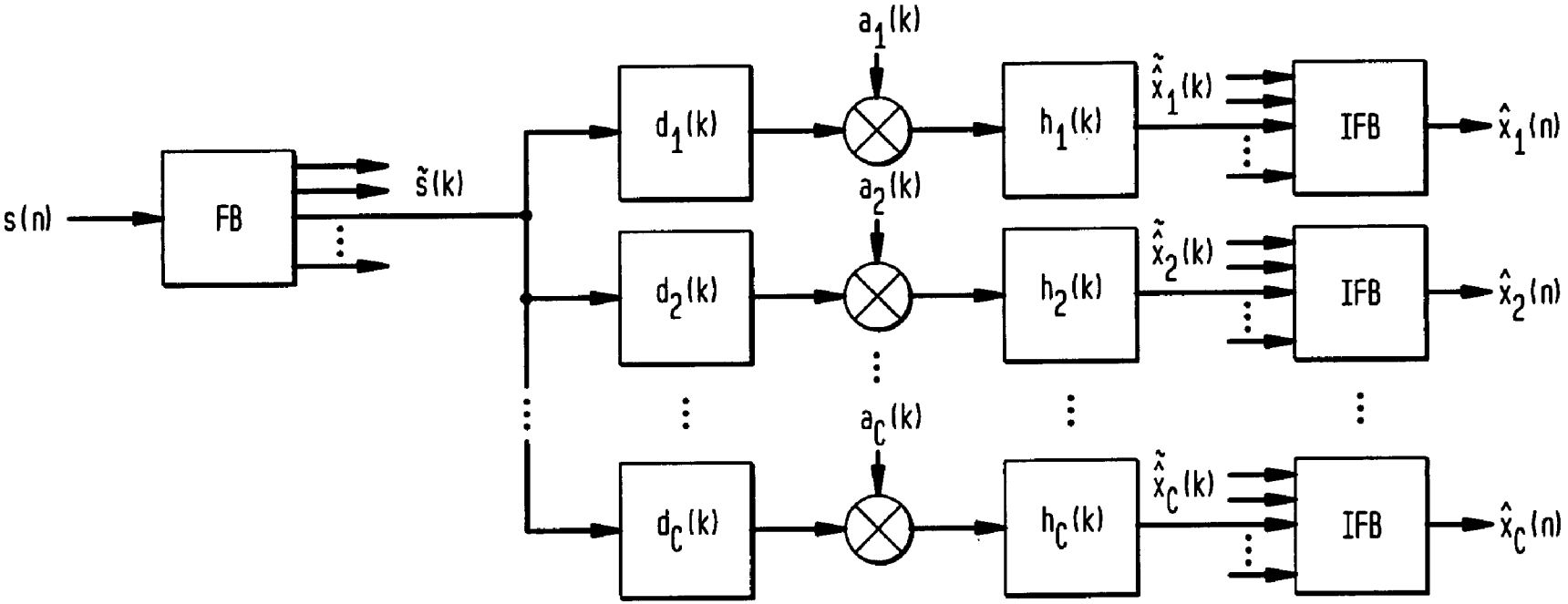
FIG. 8 shows a block diagram of an implementation of the BCC synthesizer of FIG. 4 that can be used in a BCC decoder to generate a stereo or multi-channel audio signal given a single transmitted sum signal s(n) plus the spatial cues.

FIG. 8 shows a block diagram of an implementation of BCC synthesizer 400 of FIG. 4 that can be used in a BCC decoder to generate a stereo or multi-channel audio signal given a single transmitted sum signal s(n) plus the spatial cues. The sum signal s(n) is decomposed into subbands, where $\tilde{s}(k)$ denotes one such subband. For generating the corresponding subbands of each of the output channels, delays $d_c$, scale factors $a_c$, and filters $h_c$ are applied to the corresponding subband of the sum signal. (For simplicity of notation, the time index k is ignored in the delays, scale factors, and filters.) ICTD are synthesized by imposing delays, ICLD by scaling, and ICC by applying de-correlation filters. The processing shown in FIG. 8 is applied independently to each subband.

ICTD Synthesis

The delays $d_c$ are determined from the ICTDs $\tau_{1c}(k)$, according to Equation (12) as follows:

$$d_c = \begin{cases} -\frac{1}{2}(\max_{2\le l\le C} \tau_{1l}(k) + \min_{2\le l\le C} \tau_{1l}(k)), & c = 1 \\ \tau_{1l}(k) + d_1 & 2 \le c \le C. \end{cases} \tag{12}$$

The delay for the reference channel, $d_1$, is computed such that the maximum magnitude of the delays $d_c$ is minimized. The less the subband signals are modified, the less there is a danger for artifacts to occur. If the subband sampling rate does not provide high enough time-resolution for ICTD synthesis, delays can be imposed more precisely by using suitable all-pass filters.

ICLD Synthesis

In order that the output subband signals have desired ICLDs $\Delta L_{12}(k)$ between channel c and the reference channel 1, the gain factors $a_c$ should satisfy Equation (13) as follows:

$$\frac{a_c}{a_1} = 10^{\frac{\Delta L_{1c}(k)}{20}}. \tag{13}$$

Additionally, the output subbands are preferably normalized such that the sum of the power of all output channels is equal to the power of the input sum signal. Since the total original signal power in each subband is preserved in the sum signal, this normalization results in the absolute subband power for each output channel approximating the corresponding power of the original encoder input audio signal. Given these constraints, the scale factors $a_c$ are given by Equation (14) as follows:

$$a_c = \begin{cases} 1\Big/\sqrt{1 + \sum_{i=2}^{C} 10^{\Delta L_{1i}/10}}, & c = 1 \\ 10^{\Delta L_{1c}/20} a_1, & \text{otherwise} \end{cases}. \tag{14}$$

ICC Synthesis

In certain embodiments, the aim of ICC synthesis is to reduce correlation between the subbands after delays and scaling have been applied, without affecting ICTD and ICLD. This can be achieved by designing the filters $h_c$ in FIG. 8 such that ICTD and ICLD are effectively varied as a function of frequency such that the average variation is zero in each subband (auditory critical band).

Figure 9:
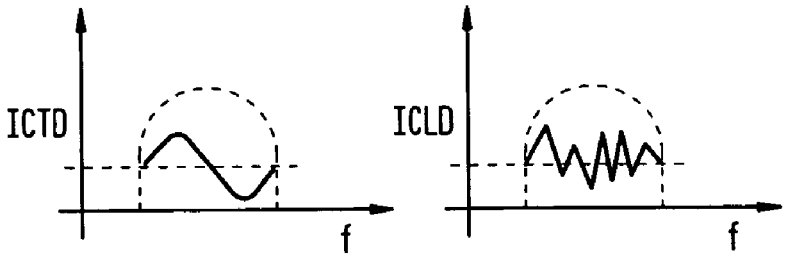
FIG. 9 illustrates how ICTD and ICLD are varied within a subband as a function of frequency.

FIG. 9 illustrates how ICTD and ICLD are varied within a subband as a function of frequency. The amplitude of ICTD and ICLD variation determines the degree of de-correlation and is controlled as a function of ICC. Note that ICTD are varied smoothly (as in FIG. 9(*a*)), while ICLD are varied randomly (as in FIG. 9(*b*)). One could vary ICLD as smoothly as ICTD, but this would result in more coloration of the resulting audio signals.

Another method for synthesizing ICC, particularly suitable for multi-channel ICC synthesis, is described in more detail in C. Faller, "Parametric multi-channel audio coding: Synthesis of coherence cues," *IEEE Trans. on Speech and Audio Proc.*, 2003, the teachings of which are incorporated herein by reference. As a function of time and frequency, specific amounts of artificial late reverberation are added to each of the output channels for achieving a desired ICC. Additionally, spectral modification can be applied such that the spectral envelope of the resulting signal approaches the spectral envelope of the original audio signal.

Other related and unrelated ICC synthesis techniques for stereo signals (or audio channel pairs) have been presented in E. Schuijers, W. Oomen, B. den Brinker, and J. Breebaart, "Advances in parametric coding for high-quality audio," in *Preprint* 114$^{th}$ *Conv. Aud. Eng. Soc.*, March 2003, and J. Engdegard, H. Purnhagen, J. Roden, and L. Liljeryd, "Synthetic ambience in parametric stereo coding," in *Preprint*

117th *Conv. Aud. Eng. Soc.*, May 2004, the teachings of both of which are incorporated here by reference.

C-to-E BCC

As described previously, BCC can be implemented with more than one transmission channel. A variation of BCC has been described which represents C audio channels not as one single (transmitted) channel, but as E channels, denoted C-to-E BCC. There are (at least) two motivations for C-to-E BCC:

- BCC with one transmission channel provides a backwards compatible path for upgrading existing mono systems for stereo or multi-channel audio playback. The upgraded systems transmit the BCC downmixed sum signal through the existing mono infrastructure, while additionally transmitting the BCC side information. C-to-E BCC is applicable to E-channel backwards compatible coding of C-channel audio.
- C-to-E BCC introduces scalability in terms of different degrees of reduction of the number of transmitted channels. It is expected that the more audio channels that are transmitted, the better the audio quality will be.

Signal processing details for C-to-E BCC, such as how to define the ICTD, ICLD, and ICC cues, are described in U.S. application Ser. No. 10/762,100, filed on Jan. 20, 2004 (Faller 13-1).

Compact Side Information

As described above, in a typical BCC scheme, the encoder transmits to the decoder ICTD, ICLD, and/or ICC codes estimated between different pairs or groups of audio channels. This side information is transmitted in addition to the (e.g., mono or stereo) downmix signal(s) in order to obtain a multi-channel audio signal after BCC decoding. Thus, it is desirable to minimize the amount of side information while not degrading subjective quality of the decoded sound.

Since ICLD and ICTD values typically relate to one reference channel, C−1 ICLD and ICTD values are sufficient to describe the characteristics of C encoded channels). On the other hand, ICCs are defined between arbitrary pairs of channels. As such, for C encoded channels, there are C(C−1)/2 possible ICC pairs. For 5 encoded channels, this would correspond to 10 ICC pairs. In practice, in order to limit the amount of transmitted ICC information, only ICC information for certain pairs are transmitted.

Figure 10:
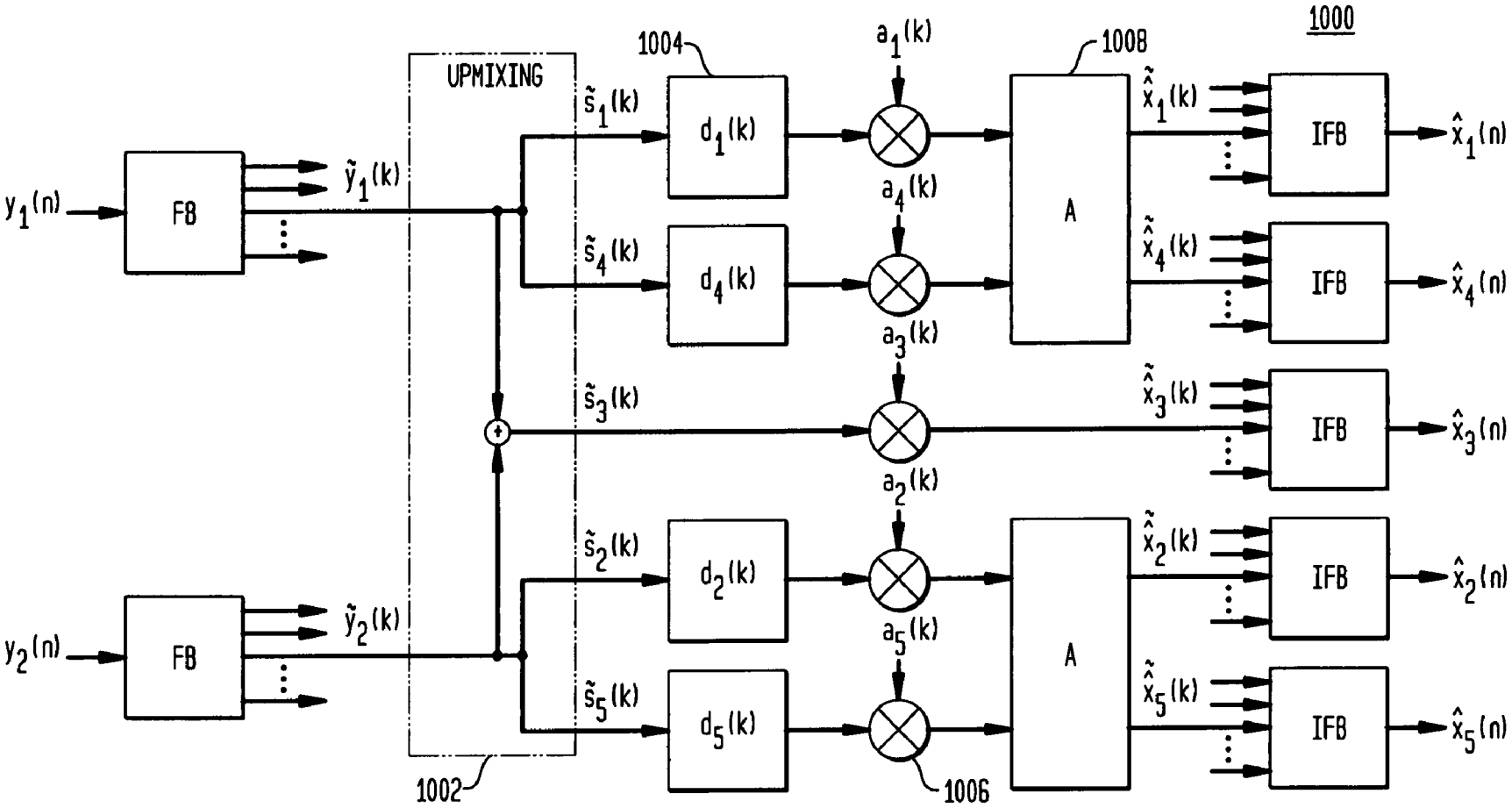
FIG. 10 shows a block diagram of a BCC synthesizer that can be used for the decoder of FIG. 2 for a 5-to-2 BCC scheme.

FIG. 10 shows a block diagram of a BCC synthesizer 1000 that can be used for decoder 204 of FIG. 2 for a 5-to-2 BCC scheme. As shown in FIG. 10, BCC synthesizer 1000 receives two input signals $y_1(n)$ and $y_2(n)$ and BCC side information (not shown) and generates five synthesized output signals $\hat{x}_1(n), \ldots, \hat{x}_5(n)$, where first, second, third, fourth, and fifth output signals correspond to the left, right, center, rear left, and rear right surround signals, respectively, shown in FIGS. 6 and 7.

Delay, scaling, and de-correlation parameters derived from the transmitted ICTD, ICLD, and ICC side information are applied at elements 1004, 1006, and 1008, respectively, to synthesize the five output signals $\hat{x}_i(n)$ from the five "upmixed" signals $\hat{s}_i(k)$ generated by upmixing element 1002. As shown in FIG. 10, de-correlation is performed only between the left and left rear channels (i.e., channels 1 and 4) and between the right and right rear channels (i.e., channels 2 and 5). As such, no more than two sets of ICC data need to be transmitted to BCC synthesizer 1000, where those two sets characterize the ICC values between the two channel pairs for each subband. While this is already a considerable reduction in the amount of ICC side information, a further reduction is desirable.

According to one embodiment of the present invention, in the context of the 5-to-2 BCC scheme of FIG. 10, for each subband, the corresponding BCC encoder combines the ICC value estimated for the "left/left rear" channel pair with the ICC value estimated for the "right/right rear" channel pair to generate a single, combined ICC value that effectively indicates a global amount of front/back de-correlation and which is transmitted to the BCC decoder as the ICC side information. Informal experiments indicated that this simplification results in virtually no loss in audio quality, while reducing transmitted ICC information by a factor of two.

In general, embodiments of the present invention are directed to BCC schemes in which two or more different ICCs estimated between different channel pairs, or groups of channels, are combined for transmission, as indicated by Equation (15) as follows:

$$ICC_{transmitted} = f(ICC_1, ICC_2, \ldots, ICC_N), \tag{15}$$

where $f$ is a function that combines N different ICCs.

In order to obtain a combined ICC measure that is representative of the spatial image, it may be advantageous to use a weighted average for function $f$ that considers the importance of the individual channels, where channel importance may be based on the channel powers, as represented by Equation (16) as follows:

$$ICC_{transmitted} = \frac{\sum_{i=1}^{N} p_i ICC_i}{\sum_{i=1}^{N} p_i}, \tag{16}$$

where $p_i$ is the power of the corresponding channel pair in the subband. In this case, ICCs estimated from stronger channel pairs are weighted more than ICCs estimated from weaker channel pairs. The combined power $p_i$ of a channel pair may be computed as the sum of the individual channel powers for each subband.

In the decoder, given $ICC_{transmitted}$, ICCs may be derived for each channel pair. In one possible implementation, the decoder simply uses $ICC_{transmitted}$ as the derived ICC code for each channel pair. For example, in the context of the 5-to-2 BCC scheme of FIG. 110 $ICC_{transmitted}$ can be used directly for the de-correlation of both the left/left rear channel pair and the right/right rear channel pair.

In another possible implementation, if the decoder estimates channel pair powers from the synthesized signals, then the weighting of Equation (16) can be estimated and the decoder process can optionally use this information and other perceptual and signal statistics arguments for generating a rule for deriving two individual, perceptually optimized ICC codes.

Although the combination of ICC values has been described in the context of a particular 5-to-2 BCC scheme, the present invention can be implemented in the context of any C-to-E BCC scheme, including those in which E=1.

Figure 11:
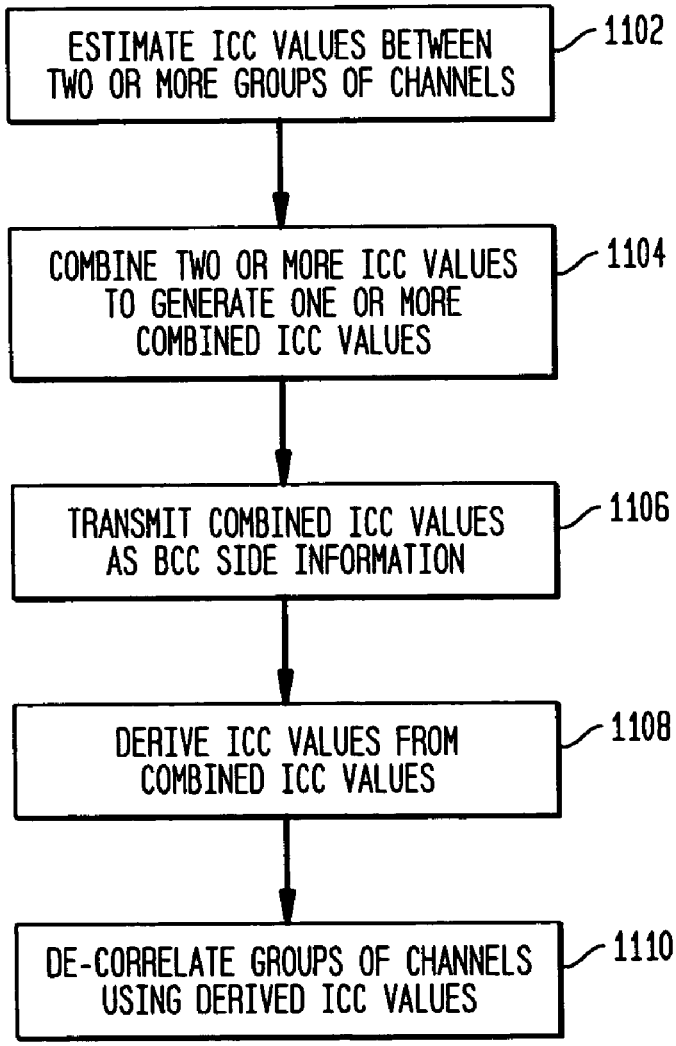
FIG. 11 shows a flow diagram of the processing of a BCC system, such as that shown in FIG. 2, related to one embodiment of the present invention.

FIG. 11 shows a flow diagram of the processing of a BCC system, such as that shown in FIG. 2, related to one embodiment of the present invention. FIG. 11 shows only those steps associated with ICC-related processing.

In particular, a BCC encoder estimates ICC values between two or more groups of channels (step 1102), combines two or more of those estimated ICC values to generate one or more combined ICC values (step 1104), and transmits the combined ICC values (possibly along with one or more "uncombined" ICC values) as BCC side information to a BCC decoder (step 1106). The BCC decoder derives two or more ICC values from the received, combined ICC values (step 1108) and de-correlates groups of channels using the derived ICC values (and possibly one or more received, uncombined ICC values) (step 1110).

Further Alternative Embodiments

The present invention has been described in the context of the 5-to-2 BCC scheme of FIG. 10. In that example, a BCC encoder (1) estimates two ICC codes for two channel pairs consisting of four different channels (i.e., left/left rear and right/right rear) and (2) averages those two ICC codes to generate a combined ICC code, which is transmitted to a BCC decoder. The BCC decoder (1) derives two ICC codes from the transmitted, combined ICC code (note that the combined ICC code may simply be used for both of the derived ICC codes) and (2) applies each of the two derived ICC codes to a different pair of synthesized channels to generate four de-correlated channels (i.e., synthesized left, left rear, right, and right rear channels).

The present invention can also be implemented in other contexts. For example, a BCC encoder could estimate two ICC codes from three input channels A, B, and C, where one estimated ICC code corresponds to channels A and B, and the other estimated ICC code corresponds to channels A and C. In that case, the encoder could be said to estimate two ICC codes from two pairs of input channels, where the two pairs of input channels share a common channel (i.e., input channel A). The encoder could then generate and transmit a single, combined ICC code based on the two estimated ICC codes. A BCC decoder could then derive two ICC codes from the transmitted, combined ICC code and apply those two derived ICC codes to synthesize three de-correlated channels (i.e., synthesized channels A, B, and C). In this case, each derived ICC code may be said to be applied to generate a pair of de-correlated channels, where the two pairs of de-correlated channels share a common channel (i.e., synthesized channel A).

Although the present invention has been described in the context of BCC coding schemes that employ combined ICC codes, the present invention can also be implemented in the context of BCC coding schemes that employ combined BCC cue codes that are generated by combining two or more BCC cue codes other than ICC codes, such as ICTD codes and/or ICLD codes, instead of or in addition to employing combined ICC codes.

Although the present invention has been described in the context of BCC coding schemes involving ICTD, ICLD, and ICC codes, the present invention can also be implemented in the context of other BCC coding schemes involving only one or two of these three types of codes (e.g., ICLD and ICC, but not ICTD) and/or one or more additional types of codes.

In the 5-to-2 BCC scheme represented in FIG. 10, the two transmitted channels $y_1(n)$ and $y_2(n)$ are typically generated by applying a particular one-stage downmixing scheme to the five channels shown in FIGS. 6 and 7, where channel $y_1$ is generated as a weighted sum of channels 1, 3, and 4, and channel $y_2$ is generated as a weighted sum of channels 2, 3, and 5, where, for example, in each weighted sum, the weight factor for channel 3 is one half of the weight factor used for each of the two other channels. In this one-stage BCC scheme, the estimated BCC cue codes correspond to different pairs of the original five input channels. For example, one set of estimated ICC codes is based on channels 1 and 4 and another set of estimated ICC codes is based on channels 2 and 5.

In an alternative, multi-stage BCC scheme, channels are downmixed sequentially, with BCC cue codes potentially corresponding to different groups of channels at each stage in the downmixing sequence. For example, for the five channels in FIGS. 6 and 7, at a BCC encoder, the original left and rear left channels could be downmixed to form a first-downmixed left channel with a first set of BCC cue codes generated corresponding to those two original channels. Similarly, the original right and right rear channels could be downmixed to form a first-downmixed right channel with a second set of BCC cue codes generated corresponding to those two original channels. In a second downmixing stage, the first-downmixed left channel could be downmixed with the original center channel to form a second-downmixed left channel with a third set of BCC cue codes generated corresponding to the first-downmixed left channel and the original center channel. Similarly, the first-downmixed right channel could be downmixed with the original center channel to form a second-downmixed right channel with a fourth set of BCC cue codes generated corresponding to the first-downmixed right channel and the original center channel. The second-downmixed left and right channels could then be transmitted with all four sets of BCC cue codes as the side information. In an analogous manner, a corresponding BCC decoder could then sequentially apply these four sets of BCC cue codes at different stages of a two-stage, sequential upmixing scheme to synthesize five output channels from the two transmitted "stereo" channels.

Although the present invention has been described in the context of BCC coding schemes in which combined ICC cue codes are transmitted with one or more audio channels (i.e., the E transmitted channels) along with other BCC codes, in alternative embodiments, the combined ICC cue codes could be transmitted, either alone or with other BCC codes, to a place (e.g., a decoder or a storage device) that already has the transmitted channels and possibly other BCC codes.

Although the present invention has been described in the context of BCC coding schemes, the present invention can also be implemented in the context of other audio processing systems in which audio signals are de-correlated or other audio processing that needs to de-correlate signals.

Although the present invention has been described in the context of implementations in which the encoder receives input audio signal in the time domain and generates transmitted audio signals in the time domain and the decoder receives the transmitted audio signals in the time domain and generates playback audio signals in the time domain, the present invention is not so limited. For example, in other implementations, any one or more of the input, transmitted, and playback audio signals could be represented in a frequency domain.

BCC encoders and/or decoders may be used in conjunction with or incorporated into a variety of different applications or systems, including systems for television or electronic music distribution, movie theaters, broadcasting, streaming, and/or reception. These include systems for encoding/decoding transmissions via, for example, terrestrial, satellite, cable, internet, intranets, or physical media (e.g., compact discs, digital versatile discs, semiconductor chips, hard drives, memory cards, and the like). BCC encoders and/or decoders may also be employed in games and game systems, including, for example, interactive software products intended to interact with a user for entertainment (action, role play, strategy, adventure, simulations, racing, sports, arcade, card, and board games) and/or education that may be published for multiple machines, platforms, or media. Further, BCC encoders and/or decoders may be incorporated in audio recorders/ players or CD-ROM/DVD systems. BCC encoders and/or decoders may also be incorporated into PC software applications that incorporate digital decoding (e.g., player, decoder) and software applications incorporating digital encoding capabilities (e.g., encoder, ripper, recoder, and jukebox).

The present invention may be implemented as circuit-based processes, including possible implementation as a single integrated circuit (such as an ASIC or an FPGA), a multi-chip module, a single card, or a multi-card circuit pack. As would be apparent to one skilled in the art, various functions of circuit elements may also be implemented as processing steps in a software program. Such software may be employed in, for example, a digital signal processor, microcontroller, or general-purpose computer.

The present invention can be embodied in the form of methods and apparatuses for practicing those methods. The present invention can also be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

It will be further understood that various changes in the details, materials, and arrangements of the parts which have been described and illustrated in order to explain the nature of this invention may be made by those skilled in the art without departing from the scope of the invention as expressed in the following claims.

Although the steps in the following method claims, if any, are recited in a particular sequence with corresponding labeling, unless the claim recitations otherwise imply a particular sequence for implementing some or all of those steps, those steps are not necessarily intended to be limited to being implemented in that particular sequence.

We claim:

1. A machine-implemented method for encoding audio channels, the method comprising:

the machine generating one or more cue codes for two or more audio channels, wherein:

at least one cue code is a combined cue code generated by combining two or more estimated cue codes; and each estimated cue code is estimated from a group of two or more of the audio channels; and the machine transmitting the one or more cue codes.

2. The method of claim 1, further comprising transmitting E transmitted audio channel(s) corresponding to the two or more audio channels, where $E \geqq 1$.

3. The method of claim 2, wherein:

the two or more audio channels comprise C input audio channels, where $C>E$; and the C input channels are downmixed to generate the E transmitted channel(s).

4. The method of claim 1, wherein the one or more cue codes are transmitted to enable a decoder to perform synthesis processing during decoding of E transmitted channel(s) based on the combined cue code, wherein the E transmitted audio channel(s) correspond to the two or more audio channels, where $E \geqq 1$.

5. The method of claim 1, wherein the one or more cue codes comprise one or more of a combined inter-channel correlation (ICC) code, a combined inter-channel level difference (ICLD) code, and a combined inter-channel time difference (ICTD) code.

6. The method of claim 1, wherein the combined cue code is generated as an average of the two or more estimated cue codes.

7. The method of claim 6, wherein the combined cue code is generated as a weighted average of the two or more estimated cue codes.

8. The method of claim 7, wherein:

each estimated cue code used to generate the combined cue code is associated with a weight factor used in generating the weighted average; and the weight factor for each estimated cue code is based on power in the group of channels corresponding to the estimated cue code.

9. The method of claim 1, wherein the combined cue code is a combined ICC code.

10. The method of claim 9, wherein:

the two or more audio channels comprise a left channel, a left rear channel, a right channel, and a right rear channel;

a first estimated ICC code is generated from the left and left rear channels;

a second estimated ICC code is generated from the right and right rear channels; and the combined ICC code is generated by combining the first and second estimated ICC codes.

11. The method of claim 1, wherein each estimated cue code is estimated from a different group of two or more of the audio channels.

12. The method of claim 11, wherein the combined cue code is not equivalent to any parameter stream containing the combined cue code.

13. Apparatus for encoding audio channels, the apparatus comprising:

means for generating one or more cue codes for two or more audio channels, wherein:

at least one cue code is a combined cue code generated by combining two or more estimated cue codes; and each estimated cue code is estimated from a group of two or more of the audio channels; and means for transmitting the one or more cue codes.

14. The apparatus of claim 13, wherein the combined cue code is generated as a weighted average of the two or more estimated cue codes.

15. The apparatus of claim 14, wherein:

each estimated cue code used to generate the combined cue code is associated with a weight factor used in generating the weighted average; and the weight factor for each estimated cue code is based on power in the group of channels corresponding to the estimated cue code.

16. The apparatus of claim 13, wherein the combined cue code is a combined ICC code.

17. Apparatus for encoding C input audio channels to generate E transmitted audio channel(s), the apparatus comprising:

a code estimator adapted to generate one or more cue codes for two or more audio channels, wherein:

at least one cue code is a combined cue code generated by combining two or more estimated cue codes; and each estimated cue code is estimated from a group of two or more of the audio channels; and a downmixer adapted to downmix the C input channels to generate the E transmitted channel(s), where C>E≧1, wherein the apparatus is adapted to transmit information about the cue codes to enable a decoder to perform synthesis processing during decoding of the E transmitted channel(s).

18. The apparatus of claim 17, wherein:

the apparatus is a system selected from the group consisting of a digital video recorder, a digital audio recorder, a computer, a satellite transmitter, a cable transmitter, a terrestrial broadcast transmitter, a home entertainment system, and a movie theater system; and the system comprises the code estimator and the downmixer.

19. The apparatus of claim 17, wherein the combined cue code is generated as a weighted average of the two or more estimated cue codes.

20. The apparatus of claim 19, wherein:

each estimated cue code used to generate the combined cue code is associated with a weight factor used in generating the weighted average; and the weight factor for each estimated cue code is based on power in the group of channels corresponding to the estimated cue code.

21. The apparatus of claim 17, wherein the combined cue code is a combined ICC code.

22. A computer-readable storage medium, having encoded thereon program code, wherein, when the program code is executed by a computer, the computer implements a method for encoding audio channels, the method comprising:

the computer generating one or more cue codes for two or more audio channels, wherein:

at least one cue code is a combined cue code generated by combining two or more estimated cue codes; and each estimated cue code is estimated from a group of two or more of the audio channels; and the computer transmitting the one or more cue codes.

23. A machine-implemented method for decoding E transmitted audio channel(s) to generate C playback audio channels, where C>E≧1, the method comprising:

the machine receiving cue codes corresponding to the E transmitted channel(s), wherein:

at least one cue code is a combined cue code generated by combining two or more estimated cue codes; and each estimated cue code estimated from a group of two or more audio channels corresponding to the E transmitted channel(s);

the machine upmixing one or more of the E transmitted channel(s) to generate one or more upmixed channels; and the machine synthesizing one or more of the C playback channels by applying the cue codes to the one or more upmixed channels, wherein:

two or more derived cue codes are derived from the combined cue code; and each derived cue code is applied to generate two or more synthesized channels.

24. The method of claim 23, wherein the cue codes comprise one or more of a combined ICC code, a combined ICLD code, and a combined ICTD code.

25. The method of claim 23, wherein the combined cue code is an average of the two or more estimated cue codes.

26. The method of claim 25, wherein the combined cue code is a weighted average of the two or more estimated cue codes.

27. The method of claim 26, wherein:

each estimated cue code used to generate the combined cue code is associated with a weight factor used in generating the weighted average; and the weight factor for each estimated cue code is based on power in the group of channels corresponding to the estimated cue code.

28. The method of claim 23, wherein the two or more derived cue codes are derived by:

deriving a weight factor for each group of two or more channels associated with an estimated cue code; and deriving the two or more derived cue codes as a function of the combined cue code and two or more derived weight factors.

29. The method of claim 28, wherein each derived weight factor is derived by:

estimating power in the group of channels corresponding to an estimated cue code; and deriving the weight factor based on the estimated powers for different groups of channels corresponding to different estimated cue codes.

30. The method of claim 23, wherein the combined cue code is a combined ICC code.

31. The method of claim 30, wherein:

the two or more audio channels comprise a left channel, a left rear channel, a right channel, and a right rear channel;

a first estimated ICC code is generated from the left and left rear channels;

a second estimated ICC code is generated from the right and right rear channels; and the combined ICC code is generated by combining the first and second estimated ICC codes.

32. The method of claim 31, wherein:

the combined ICC code is used to de-correlate synthesized left and left rear channels; and the combined ICC code is used to de-correlate synthesized right and right rear channels.

33. Apparatus for decoding E transmitted audio channel(s) to generate C playback audio channels, where C>E≧1, the apparatus comprising:

means for receiving cue codes corresponding to the E transmitted channel(s), wherein:

at least one cue code is a combined cue code generated by combining two or more estimated cue codes; and each estimated cue code estimated from a group of two or more audio channels corresponding to the E transmitted channel(s);

means for upmixing one or more of the E transmitted channel(s) to generate one or more upmixed channels; and means for synthesizing one or more of the C playback channels by applying the cue codes to the one or more upmixed channels, wherein:

two or more derived cue codes are derived from the combined cue code; and each derived cue code is applied to generate two or more synthesized channels.

34. The apparatus of claim 33, wherein the combined cue code is a weighted average of the two or more estimated cue codes.

35. The apparatus of claim 34, wherein:

each estimated cue code used to generate the combined cue code is associated with a weight factor used in generating the weighted average; and the weight factor for each estimated cue code is based on power in the group of channels corresponding to the estimated cue code.

36. The apparatus of claim 33, wherein the combined cue code is a combined ICC code.

37. Apparatus for decoding E transmitted audio channel(s) to generate C playback audio channels, where C>E≧1, the apparatus comprising:

a receiver adapted to receive cue codes corresponding to the E transmitted channel(s), wherein:

at least one cue code is a combined cue code generated by combining two or more estimated cue codes; and each estimated cue code estimated from a group of two or more audio channels corresponding to the E transmitted channel(s);

an upmixer adapted to upmix one or more of the E transmitted channel(s) to generate one or more upmixed channels; and a synthesizer adapted to synthesize one or more of the C playback channels by applying the cue codes to the one or more upmixed channels, wherein:

two or more derived cue codes are derived from the combined cue code; and each derived cue code is applied to generate two or more synthesized channels.

38. The apparatus of claim 37, wherein:

the apparatus is a system selected from the group consisting of a digital video player, a digital audio player, a computer, a satellite receiver, a cable receiver, a terrestrial broadcast receiver, a home entertainment system, and a movie theater system; and the system comprises the receiver, the upmixer, and the synthesizer.

39. The apparatus of claim 37, wherein the combined cue code is a weighted average of the two or more estimated cue codes.

40. The apparatus of claim 39, wherein:

each estimated cue code used to generate the combined cue code is associated with a weight factor used in generating the weighted average; and the weight factor for each estimated cue code is based on power in the group of channels corresponding to the estimated cue code.

41. The apparatus of claim 37, wherein the combined cue code is a combined ICC code.

42. A computer-readable storage medium, having encoded thereon program code, wherein, when the program code is executed by a computer, the computer implements a method for decoding E transmitted audio channel(s) to generate C playback audio channels, where C>E≧1, the method comprising:

the computer receiving cue codes corresponding to the E transmitted channel(s), wherein:

at least one cue code is a combined cue code generated by combining two or more estimated cue codes; and each estimated cue code estimated from a group of two or more audio channels corresponding to the E transmitted channel(s);

the computer upmixing one or more of the E transmitted channel(s) to generate one or more upmixed channels; and the computer synthesizing one or more of the C playback channels by applying the cue codes to the one or more upmixed channels, wherein:

two or more derived cue codes are derived from the combined cue code; and each derived cue code is applied to generate two or more synthesized channels.

* * * * *